United States Patent [19]

Horrer et al.

[11] 4,213,507

[45] Jul. 22, 1980

[54] GRADING VEHICLE

[76] Inventors: Erwin Horrer, Michael Steinherrstrasse 27; Gustav Leidinger, Michael Steinherrstrasse 16, both of Friedberg, Fed. Rep. of Germany, 8904

[21] Appl. No.: 844,593

[22] Filed: Oct. 25, 1977

[30] Foreign Application Priority Data

Oct. 23, 1976 [DE] Fed. Rep. of Germany ... 7633233[U]
Feb. 18, 1977 [DE] Fed. Rep. of Germany ..... 2707006

[51] Int. Cl.[2] ..... E02F 3/76

[52] U.S. Cl. ..... 172/784; 172/787; 172/788; 172/796

[58] Field of Search ..... 172/250, 253, 254, 777, 172/781, 784, 785, 788, 789, 791, 792, 793, 795, 796, 797, 799, 699, 700, 786, 787

[56] References Cited

U.S. PATENT DOCUMENTS

| | | | |
|---|---|---|---|
| 2,748,509 | 6/1956 | Brown et al. | 172/799 |
| 3,763,938 | 10/1973 | Brodersen | 172/789 |
| 3,822,756 | 7/1974 | Martin | 172/253 X |
| 3,880,243 | 4/1975 | Gurries et al. | 172/784 |
| 3,887,015 | 6/1975 | Kelley | 172/699 X |
| 3,976,146 | 8/1976 | Desourdy | 172/788 |
| 4,071,090 | 1/1978 | Easterling | 172/788 |

FOREIGN PATENT DOCUMENTS

| | | | |
|---|---|---|---|
| 1096835 | 1/1961 | Fed. Rep. of Germany | 172/785 |

*Primary Examiner*—Richard T. Stouffer
*Attorney, Agent, or Firm*—Burton, Parker & Schramm

[57] ABSTRACT

A grading vehicle including a bridging vehicle chassis between a front axle and its corresponding wheels and a rear vehicle section having at least one axle with corresponding rear wheels, and control equipment mounted on said chassis, which equipment provides for adjustment in all directions of a grading device suspended therefrom and mounted between the front axle and the rear section of the vehicle, which grading device is connected by a universal joint to the rear section of the vehicle which carries a driving engine, the grading device includes a scraping blade which is of length corresponding substantially to the width of the vehicle, and the front wheels being driven wheels.

7 Claims, 6 Drawing Figures

GRADING VEHICLE

The invention relates to a grading vehicle with a bridging chassis between its front axle and the one-axled or multi-axled rear part of the vehicle, and with adjusting devices such as lifting and swiveling mechanisms mounted on the chassis, which mechanisms permit adjustment in all directions of a grading device suspended from them, which latter is supported on the rear, drive-engine-bearing part of the vehicle at at least one universal joint.

Such a grading vehicle, as the carrier of a grading device, is known, where a set of planing blades is mounted on the ring mount of a triangular seat, said vehicle being called a "grading plane" or "grader". With such a grading plane, surfaces of any slope can be produced and smoothed. The suspension of the set of planing blades permits lateral banking and swiveling of the long, narrow set of blades, together with a very delicate raising and lowering, in order to achieve an accurate fine surfacing. The lateral thrust generated by the working pressure of the set of blades can be counteracted by the directional stabilizing effect of the camber setting of the front wheels, which is possible in these known grading planes.

Also known are grading planes with supplementary front-wheel drive, whereby an increase of specific traction is attained.

For heavier-duty scraping operation and for relatively large material-moving requirements, grading vehicles are also known which run on caterpillar tracks or specially designed wide tires in order to achieve the required traction. These so-called "bull-dozers" or "wheel grading vehicles" can be fitted with a rigid scraper blade, the cross blade, or one capable of restricted horizontal swing, the swivel blade. These scraper blades are comparatively short and deep, and are open at the front and top, in order to achieve a more favourable specific scraping pressure, and where movements of material are involved, to fill up the scraping blade movements of material are involved, to fill up the scraping blade well on the one hand, and so as not to exceed the vehicle width when travelling on a road on the other hand. These blades are heavily constructed and can therefore absorb large forces which are introduced, for the most part laterally, into the vehicle chassis via U-shaped sliding frames or spars. The flexibility of these scraping blades, obviously, is very slight compared with that of the sets of planing blades of the grading plane.

The known design of the grading plane is restricted in its earth-moving capacity with respect to quantity and loading of material, and hence, except for the production of a fine smooth surface, in any plane or on any inclination, cannot be used for heavy-duty scraping operations.

The aim of the invention is to produce a grading vehicle of the initially described kind which can also perform heavy-duty scraping operations after the fashion of a bulldozer or wheel grading vehicle.

This task is solved in the invention by including a scraping blade in the grading device, which blade is shortened almost to the width of the vehicle, and also by providing front-wheel drive.

Through the essentially known additional front-wheel drive additional traction is obtained which comes close, in order of magnitude, to that of traditional bulldozers or wheel grading vehicles. Also, in the invented apparatus the grading device is a scraping blade which is shortened approximately to the width of the vehicle.

Both measures, in combination with the features described in the generic part of the main claim, bring about the overall result in a mutually furthering and reinforcing manner, which result consists in the fact that a grading vehicle very similar in appearance to a grading plane can, according to the invention, undertake the work of bulldozers or wheel grading vehicles. Obviously, the scraping blade employed can possess the blade depth usual in scraping blades in order to be able to push required accumulations of material ahead of them, as is customary, for example, in the case of bulldozers, and which greatly exceeds what has previously been possible with a grading plane having a supplementary blade suspended in front of it, for example in order to fill up holes in the ground or other major terrain irregularities. In this connection the universal joint affords a particularly favourable absorption of the considerable thrust forces on the rear part of the vehicle.

The shortening of the scraping blade to approximately the width of the vehicle, together with the front-wheel drive, results in about twice the specific traction, i.e. the traction per unit area of ground cross section engaged by the scraping blade. This brings about a further improvement for the execution of operations which hitherto called for bulldozers and wheel grading vehicles.

In general a single universal joint is provided mounted in the vertical, central longitudinal plane of the vehicle; it may also be advantageous, however, to use two universal joints disposed on either side of the longitudinal central plane of the vehicle.

Advantageously, the grading apparatus possesses a central supporting arm projecting from the universal joint, a vertical swivel axle disposed centrically thereon for hinge-mounting the scraping blade, and two variable-length struts hinged between the scraping blade and the rear of the supporting arm. This manner of suspending the scraping blade permits the attainment of relatively large angles for lateral banking and swiveling, and even sidewards deflection of the scraping blade beyond the width of the vehicle is assured, which is not possible in conventional bulldozers or wheel grading vehicles, which, moreover, do not possess the special sensitivity in the actuation of the lifting mechanism that the invented grading vehicle displays. The fact that the scraping blade is situated within the wheel base also reduces the blade deflection in the vertical direction by about one half, for example, when traversing a depression in the ground. The invented grading vehicle thus achieves an approximately three-times better grading quality compared with wheel grading vehicles or bulldozers with front-mounted scraping blades. If normal flatness is acceptable, then we attain e.g. the elimination of a ground depression in fewer passes than before.

With the variable-length struts, expediently piston-and-cylinder units, the scraping blade can be rotated in its angular position about its vertical swivel axis. The fully rotated scraping blades are then situated in the travel path of the vehicle, so that there are no restrictions to its being driven on public roads. This great rotatability about the vertical swivel axis replaces the known rotatability of the set of planing blades of a grading plane with its ring mount as far as the normally required amount; hence the work of a grading plane, where no extreme adjustments of the set of blades is required, can be performed with the invented grading vehicle, again with normal accuracy. To that extent the new grading vehicle is a multi-purpose one. The functions of "banking" and "swiveling" together are so difficult to realize in known bulldozers and wheel grading vehicles that in practice they are hardly ever attempted. With the invented design this can take place in the simplest manner with the aid of the available lifting and swiveling mechanism.

Expediently, the supporting arm is sufficiently long and the struts are sufficiently extendable so that the scraping blade can be rotated through at least ±35°.

Finally, at the back of the scraping blade and/or on the supporting arm at least one extendable and retractable ripping tooth can be mounted. If such a ripping tooth points backwards with its bent tip towards the rear of the vehicle, then, with the grading vehicle in reverse, it can plough up the ground, and the soil thus loosened can be moved when the scraping blade moves forwards.

In the case of jobs where still greater rotatability of a set of blades with ring mount is indispensable, the invented scraping apparatus, as a structural unit, is preferably made interchangeable with a triangular swivel seat with ring mount and set of blades. Through this interchangeability, the invented grading vehicle can be used both as a wheel grading vehicle which can largely perform the scraping and planing operations as well, and as a pure grading plane, as well, for operations which demand a considerable swiveling of the scraping blade, or in this case of the set of blades, in which case a ring mount is essential. The invented grading vehicle can then be used all the time, which not only justifies the extra expense of all-wheel drive, but also permits the rational adoption, where required, of a buckle joint.

The invention is described more fully hereinafter in the form of a preferred embodiment represented in the drawing.

Figure 1:
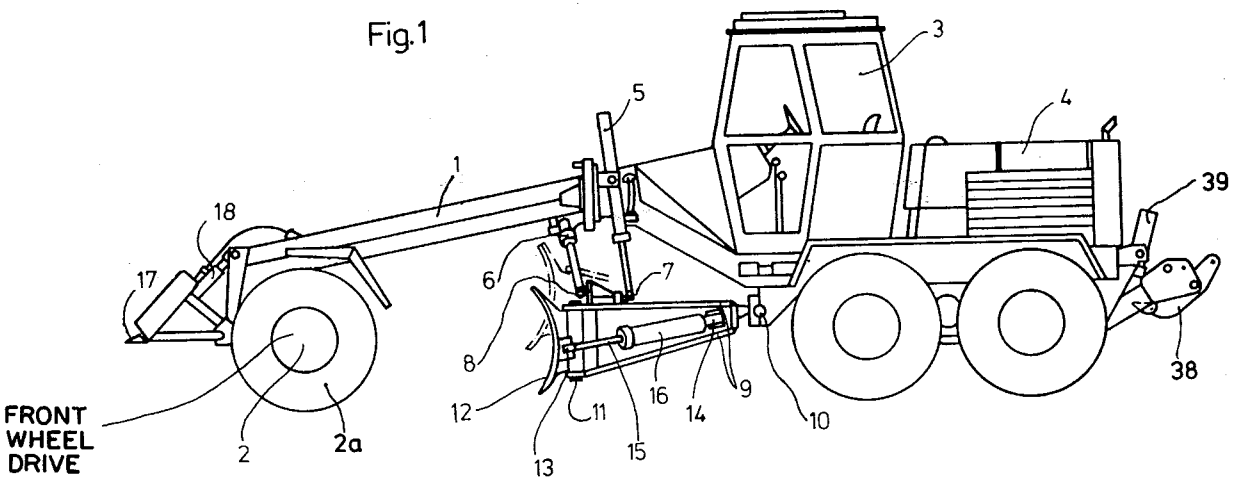
FIG. 1 shows a side elevation of the grading vehicle.

The grading vehicle shown in the drawing possesses a a bridging chassis 1 between its front axle 2 bearing front wheels 2*a* and the rear part 4 of the vehicle, with one or more axles, carrying the driving engine and the driver's cab 3. On the bridging chassis 1 two hydraulic lifting mechanisms 5, 5' and a swivelling cylinder 6 are mounted, on whose piston rods a supporting arm 9 is suspended at 7 and 8. These lifting and swiveling mechanisms, comprising adjusting devices, permit adjustment of the grading equipment suspended from them and possessing supporting arm 9, which is supported in turn at at least one universal joint 10 on the vehicle. Supporting arm 9, at its front end, possesses a vertical swivel axis 11 in the centre of supporting arm 9.

According to the invention the grading equipment possesses a scraping blade 12 which is shortened to nearly the width of the vehicle. Also, front wheels 2*a* are driven by a front-wheel drive which is not shown.

Scraping blade 12 is hinged at swivel axis 11.

As already mentioned, through the use of a front-wheel drive and the shortening of scraping blade 12 to nearly the width of the vehicle, approximately double the specific traction is obtained.

The universal joint is mounted on rear vehicle section 4, which carries the drive engine. However, e.g. two universal joints, one on either side of the vertical longitudinal centre plane of the grading vehicle, could be provided.

Figure 2:
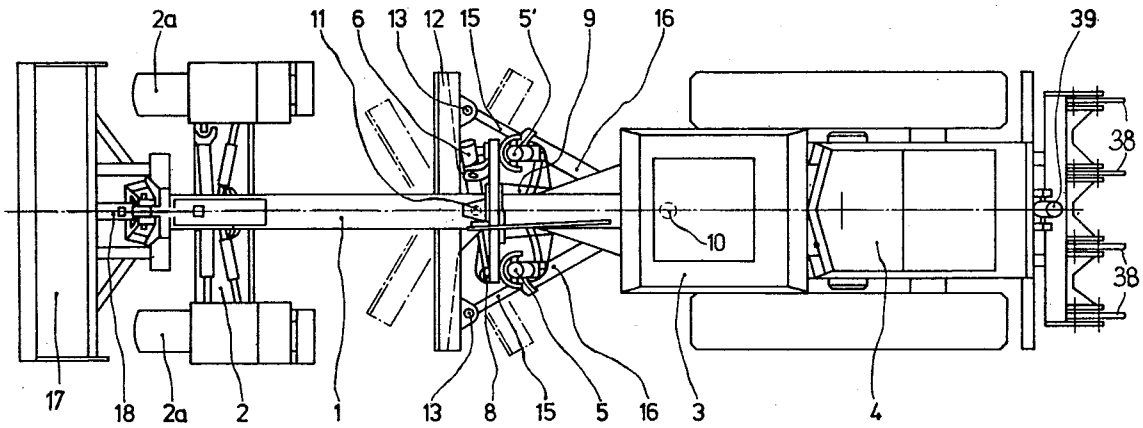
FIG. 2 shows a plan view.
Figure 3:
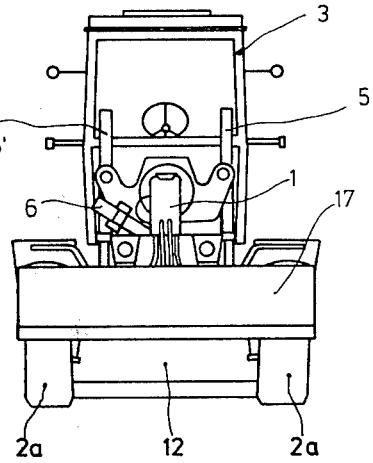
FIG. 3 is a front elevation.
Figure 4:
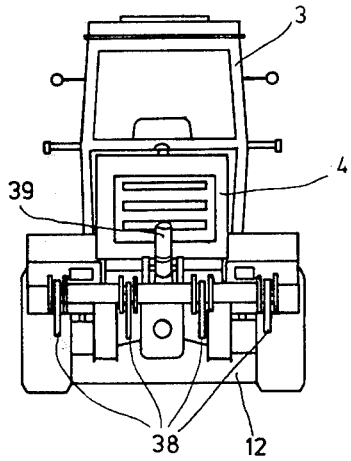
FIG. 4 is a view from the rear.

Besides supporting arm 9, already mentioned, which projects forwards from universal joint 10, as well as swivel axis 11 disposed centrally and vertically for mounting scraping blade 10, grading apparatus 2 also has variable-length struts 15 and 16. These struts 15, 16 join suspension hinges 13 on scraping blade 12 to suspension hinges 14 at the rear of support arm 9. Struts 15, 16 are constructed in two parts as piston-and-cylinder units and permit the swiveling of scraping blade 12 from the intermediate position represented in solid lines in FIG. 2 about swivel axis 11 into the positions represented in dot-dash lines, where the ends of scraping blade 12 remain within the travel path of the vehicle.

Expediently, supporting arm 9 is sufficiently long and struts 15, 16 are so extendable that scraping blade 12 is rotatable through at least ±35°.

Figure 5:
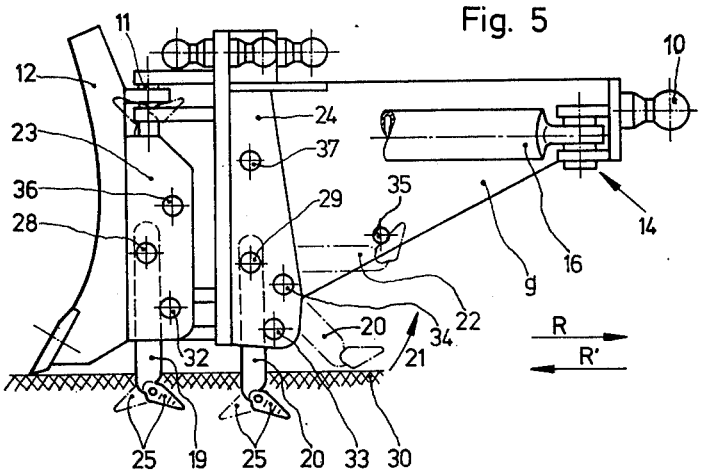
FIG. 5 is a side elevation of the scraping apparatus in more advanced form.
Figure 6:
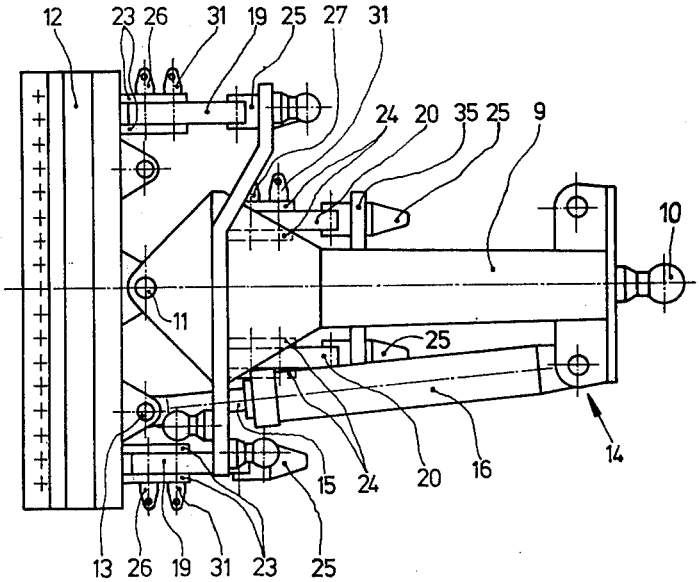
FIG. 6 is a plan view of the scraping apparatus according to FIG. 5.

As can be seen from FIGS. 5 and 6, other operating parts can be advantageously applied to supporting arm 9 and/or scraping blade 12. In the embodiment represented, several ripping teeth 19 and 20, which can fold in and out of their working positions, are disposed on the back of scraping blade 12 and on supporting arm 9, and specifically two ripping teeth 19 are on the back of scraping blade 12 and two ripping teeth 20 on supporting arm 9. Ripping teeth 19 are secured by double straps 23, and ripping teeth 20 by double straps 24, in both cases with the aid of pass-through pins 26 and 27 respectively, indicated in FIG. 6, which can pass through holes 28 and 29 represented in FIG. 5 and retain ripping teeth 19 and 20 pivotally in double straps 23 and 24. As is easily realized, ripping teeth 19 and 20 dig into the earth 30 during motion in reverse in arrow direction R (FIG. 5). Then, when the grading vehicle moves forwards again in arrow direction R' (FIG. 5) ripping teeth 19 and 20 can swing backwards and upwards in arrow direction 21, as is indicated by dot-dash lines for a ripping tooth 20 in FIG. 5. Simultaneously, scraping blade 12 is able to move the loosened ground.

If ripping is to take place during the forward motion (arrow direction R'), in which case ground is torn up and moved forward simultaneously, the ripping teeth 19 and 20 merely need to be secured to double straps 23 and 24 in the manner depicted, rotated through 180°, so that their tips 25 point forwards in the manner indicated with dot-dash lines in FIG. 5. In this case, however, additional pass-through pins 31 (FIG. 6), which can pass through corresponding holes 32 and 33 (FIG. 5) are provided and constitute the necessary support.

Ripping teeth 19 and 20, finally, can be turned back and up, again in arrow direction 21 (FIG. 5). Ripping teeth 20 are then turned into the position shown in dot-dash lines in FIG. 5 with 22 and are secured against dropping downwards by a cotter pin to be installed in hole 34. In addition, a safety rod, which is indicated at 35, can be provided above ripping teeth 20. However, the dot-dash-indicated intermediate position (drag position) of ripping tooth 20, which can be secured by a pass-through pin in hole 33, may also suffice.

Ripping teeth 19, on the other hand, can be folded all the way up and secured by means of pass-through pins in holes 36 provided in retaining straps 23. For ripping teeth 20 mounted on supporting arm 9 there is also another possibility of fastening, namely they can be suspended in hole 37 shown in FIG. 5 and secured by means of pass-through pins in hole 33.

This grading equipment comprising parts 9, 11, 12, 13, 14, 15, 16 constitutes a structural unit which is removable at 7, 8 and 10 and can be replaced by an essentially known, not shown, triangular swivel seat with ring mount and set of planing blades. In front, an auxiliary blade operable by means of a hydraulic cylinder 18, can be mounted for clearing debris or filling in rough holes in the terrain. At the rear scarifier blades 38 can be mounted which are raisable and lowerable by means of a hydraulic cylinder 39.

Owing to the interchangeability of the grading equipment for the known triangular swivel seat, the invented grading vehicle can also be equipped exclusively for the ordinary work of a grader, in which case the ring mount permits rotation of the set of planing blades through a particularly wide angle, in a known manner. The scarifying teeth 38 can be used, for example, to tear up the asphalt cover of a roadway, the top of which is to be removed with the scraping blade, for example with a view to resurfacing.

Of special advantage is the mounting of auxiliary blade 17 or a second scraping blade at the front of bridging vehicle chassis 1 ahead of front axle 2, said scraping blade being raisable and lowerable or tiltable by means of hydraulic equipment 18. The removable of debris or the filling in of rough holes in the terrain with this second scraping blade has already been mentioned, since it is expedient to create the smoothest possible ground for the grading vehicle to run on. It is obvious, that is to say, that relatively large holes in the ground cannot be filled by first scraping blade 12, since of course this blade is mounted between front axle 2 and rear vehicle section 4. Now, it is surprising that the invented grading vehicle with second scraping blade 17, which advantageously has approximately the same width as first scraping blade 12, can pile up mounds, take them down, pierce mounds or barriers and remove holes in the ground more effectively than conventional grading vehicles or bulldozers. When piling debris, mounds or barriers, first of all scraping blade 12 mounted between the axles is made to push the earth together over a certain distance to form an initial pile. The grading vehicle is then reversed, front wheels 2*a* traversing this pile. The vehicle then advances again, pushing the initial pile of earth farther ahead with second grading blade 17, while at the same time, for example, at which it has already built up the first pile, first scraper blade 12 pushes additional earth together to form a second pile. Thus at every advance, the invented grading vehicle pushes a pile of earth with its first scraping blade 12 to the foot of the heap of debris, mound or barrier, while at the same time the front-mounted, second scraping blade pushes this material started by first scraping blade 12 upwards to the top or crest of said mound or barrier. With increasing height, of course, the grading vehicle moves up the slope of e.g. the barrier, so that first scraping blade 12 pushes the piles of earth formed a corresponding distance up the slope.

At the same time, rear vehicle section 4 preferably still remains on the flat in front of the heap and its wheels only meet the slope.

If the earth is always taken from the same place, then obviously a deep hole will be dug. The invented grading vehicle is thus capable of producing e.g. armoured vehicle holes in a particularly easy and rapid manner.

For piercing a pile of debris or barrier the invented grading vehicle is also superior to a conventional bulldozer. That is to say, whereas a bulldozer must first run up the slope of the pile and move in a slanted position before it can begin to take down the top of the pile with its scraping blade, so that the dozer can only exert its traction force on a slant upwards, the length of the invented grading vehicle enables it, in the case of normal piles of debris with heights of approximately 2 to 5 m, to operate in such a way that rear vehicle section 4 will still be on the flat at the foot of the pile.

Once part of the barrier has been pierced, scraping blade 12 can then be used in the manner depicted above with reference to the building up of a barrier or excavation of a hole in the ground, in such a way that first scraping blade 12 pushes earth ahead, while second scraping blade 17 is pushing initially pushed material farther down through the place of attack.

The fact that rear vehicle section 4 is still on the flat means that only the front part of the vehicle with second scraping blade 17 and bridging chassis with first scraping blade 12 are working on the slope. As a result of the typical load distribution in the invented grading vehicle, this involves only about one third of the weight of the vehicle, so that about two thirds of the weight does not have to run up the slope. For this reason, a greater proportion of the traction force is available for thrusting earth up by means of the first and second scraping blades 12 and 17. With conventional grading vehicles, however, a much greater proportion of the traction force is required to move the weight of the grading vehicle itself up the slope. It must be borne in mind here that with these conventional grading vehicles about 60% of the total weight is borne on the front axle. As a consequence, larger quantities of earth can be piled up with the invented grading vehicle for the same expenditure of energy. The described, preferred embodiment of the invented grading vehicle with a first scraping blade 12 and a second scraping blade 17 permits a comparatively small width of first scraping blade 12 as well as of second scraping blade 17, which preferably has approximately the same width as the first scraping blade. The consequence of this is, first of all, that, for the reasons mentioned at the outset, the desired high specific thrust force is obtained on first scraping blade 12. This high specific thrust force is of special advantage at the place where particularly difficult soil conditions prevail, e.g. in cohesive loamy soil, highly compacted soils with inclusions of rock, or the like. In such soil conditions the traction force of the machine is needed in full measure by first scraping blade 12. In this case the second scraping blade 17 remains out of action in the raised position.

Where the soil conditions are easier, e.g. in loose sand, gravel or already formed piles of debris, second scraping blade 17 can be brought into play simultaneously with first scraping blade 12, so that the available thrust force is distributed over the two blades and a considerably larger volume of material can be moved. This volume of material can be almost doubled. This possibility of selective operation of the grading vehicle, employing only one scraping blade or two, depending on soil conditions, is particularly advantageous and economical, since so-called heavy and light requirements frequently alternate.

Obviously, the design and mounting of second blade 17 on the front of the invented grading vehicle can be accomplished with relatively long push rods of the kind usual in bulldozers and as represented in the drawing, in such a way that second scraping blade 17 can be further raised or lowered accordingly, and in addition can also be tilted as required.

We claim:

1. An improved grading vehicle comprising:

a rear vehicle section which has a rear axle and an engine;

a front bridging vehicle chassis, one end of which is connected to the rear vehicle section, said chassis being of substantially smaller cross-section than the rear vehicle section where joined;

front wheels mounted on the other end of said chassis;

control equipment mounted on said chassis;

a grading device suspended from said equipment so as to be mounted between the front wheels and the rear section of the vehicle, said equipment acting to adjust said grading device in all directions, said wheels being driven; and a universal joint for supporting the grading device which is mounted directly to the rear section at a location on said rear section spaced below where the chassis is connected to said rear section to trasmit thrust between said grading device and said rear section without tending substantially to raise the bridging chassis without simultaneous raising of the engine.

2. Grading vehicle according to claim 1, characterized in that the grading apparatus possesses a central supporting arm (9) projecting from the universal joint (10), a vertical swivel axis (11) centrally mounted thereon for hinge-mounting the scraping blade (12), and two variable-length struts (15, 16) hinged between the scraping blade (at 13) and the rear end of the supporting arm (at 14).

3. Grading vehicle according to claim 2, characterized in that the length of the supporting arm (9) is such and the struts (15, 16) are extendable in such a way, that the scraping blade (12) can be swiveled about at least ±35°.

4. Grading vehicle according to claim 1, characterized in that on the back of the scraping blade (12) at least one ripping tooth (19, 20), which can be folded in and out of its working position, is mounted, said ripping tooth reversible so to enable operation during either forward or rearward movement.

5. Grading vehicle according to claim 1, characterized in that at the front end of the bridging vehicle chassis (1) ahead of the front axle (2) a second scraping blade (17) is mounted frontally and is raisable, lowerable and tiltable by means of at least one hydraulic apparatus (18).

6. Grading vehicle according to claim 5, characterized in that the second scraping blade (17) has approximately the same width as the first scraping blade (12).

7. The improved grading vehicle of claim 1 further characterized in that the grading device has a shield of a length substantially equivalent to the width of the vehicle.

* * * * *